US010550719B2

(12) United States Patent
Nishitani et al.

(10) Patent No.: US 10,550,719 B2
(45) Date of Patent: Feb. 4, 2020

(54) TRIP SYSTEM FOR STEAM TURBINE

(71) Applicant: MITSUBISHI HEAVY INDUSTRIES COMPRESSOR CORPORATION, Tokyo (JP)

(72) Inventors: Ken Nishitani, Hiroshima (JP); Abhay Jain, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 2 days.

(21) Appl. No.: 15/769,048

(22) PCT Filed: Dec. 17, 2015

(86) PCT No.: PCT/JP2015/085307

§ 371 (c)(1),
(2) Date: Apr. 17, 2018

(87) PCT Pub. No.: WO2017/104036

PCT Pub. Date: Jun. 22, 2017

(65) Prior Publication Data

US 2019/0063255 A1 Feb. 28, 2019

(51) Int. Cl.
*F01D 21/00* (2006.01)
*F01D 21/18* (2006.01)
(Continued)

(52) U.S. Cl.
CPC ..... *F01D 21/18* (2013.01); *F01D 17/145* (2013.01); *F01D 21/16* (2013.01);
(Continued)

(58) Field of Classification Search
CPC ..... F01D 21/18; F01D 21/00; F01D 21/16; F01D 17/145; F01D 17/20; F01D 17/26;
(Continued)

(56) References Cited

U.S. PATENT DOCUMENTS

2017/0268432 A1* 9/2017 Niiyama ..... F01D 17/20

FOREIGN PATENT DOCUMENTS

JP S55-101706 A 8/1980
JP S58-8206 A 1/1983
(Continued)

OTHER PUBLICATIONS

International Search Report issued in corresponding International Application No. PCT/JP2015/085307 dated Mar. 22, 2016 (5 pages).
(Continued)

*Primary Examiner* — Craig J Price
(74) *Attorney, Agent, or Firm* — Osha Liang LLP

(57) ABSTRACT

A trip system for a steam turbine closes a trip-and-throttle valve and a control valve of a steam turbine in an emergency. The trip system includes: an emergency shut-off device that shuts off supply of control oil for the trip-and-throttle valve and the control valve to close the trip-and-throttle valve and the control valve; and a drain device that includes a plurality of solenoid valves connected in parallel and drains the control oil by opening the solenoid valves. The emergency shut-off device includes a cylinder, a piston that slides in the cylinder, a spring that applies biasing force to the piston, a plurality of piston valves provided to the piston, and a plurality of chambers formed by the piston valves.

6 Claims, 6 Drawing Sheets

(51) Int. Cl.
*F01D 17/14* (2006.01)
*F01D 21/16* (2006.01)

(52) U.S. Cl.
CPC .... *F05D 2270/09* (2013.01); *F05D 2270/091* (2013.01); *F05D 2270/56* (2013.01); *Y10T 137/8663* (2015.04); *Y10T 137/87217* (2015.04)

(58) Field of Classification Search
CPC ..... F05D 2270/09; F05D 2270/091; F05D 2270/56; F05D 2260/83; F15B 20/00–008; F15B 21/00; F15B 21/005; F15B 19/00–007; F15B 13/0402; F16K 3/00–36; F16K 11/00–24; F02C 29/46; F01L 31/00–18; F05B 2270/021; F05B 2270/064; Y10T 137/87217; Y10T 137/87225; Y10T 137/8663
See application file for complete search history.

(56) References Cited

FOREIGN PATENT DOCUMENTS

| | | | |
|---|---|---|---|
| JP | H03-51284 | U | 5/1991 |
| JP | H05-64401 | U | 8/1993 |
| JP | H07-145705 | A | 6/1995 |
| JP | H09-119530 | A | 5/1997 |
| JP | H10-131711 | A | 5/1998 |
| JP | 2001-55903 | A | 2/2001 |
| JP | 2001-241559 | A | 9/2001 |
| JP | 2015-161204 | A | 9/2015 |

OTHER PUBLICATIONS

International Preliminary Report on Patentability issued in corresponding International Application No. PCT/JP2015/085307 dated Jun. 28, 2018 (13 pages).

* cited by examiner

TRIP SYSTEM FOR STEAM TURBINE

TECHNICAL FIELD

The present invention relates to a trip system for a steam turbine.

BACKGROUND

An emergency shut-off device is installed to immediately close the trip-and-throttle valve (hereinafter called the TTV) to urgently stop a steam turbine in case of an emergency (such as an overspeed or an excessive shaft vibration), which prevents safe operation of the steam turbine has occurred.

PRIOR ART DOCUMENT

Patent Document

Patent Document 1: Japanese Patent Application Publication No. Hei 9-119530

Patent Document 2: Japanese Utility Model Registration Application Publication No. Hei 5-64401

FIGS. 6 and 7 illustrate a conventional trip system. Note that FIG. 6 illustrates a state in normal operation (during operation of a steam turbine), and FIG. 7 illustrates a state at the time of tripping. In the conventional trip system, an emergency shut-off device 70 is used to supply and drain control oil to and from a TTV 91 and an extraction control valve (hereinafter called an ECV) 92 of the steam turbine (not illustrated). Note that this emergency shut-off device 70 also supplies and drains the control oil to and from a governor valve (hereinafter called a GV) 93.

The emergency shut-off device 70 includes a trip piston 72 and a trip pilot valve 77 disposed in parallel with each other inside a cylinder 71. An end rod 73*b* on one end side (the left side in the figure) of a rod 73*a* of the trip piston 72 passes through the cylinder 71 and is exposed to the outside. Provided at the end of the end rod 73*b* is a trip button 73*c*. Provided on the other end side (the right side in the figure) of the rod 73*a* is a piston valve 74, from which an end rod 73*d* extends. The end rod 73*d* passes through the cylinder 71 and is exposed to the outside. The end of the end rod 73*d* is in contact with a lever portion 76*a* of a cam 76. In addition, the rod 73*a* is provided with a spring 75 which applies a biasing force to the rod 73*a* in the direction toward the cam 76.

An end rod 78*b* on one end side (the left side in the figure) of a rod 78*a* of the trip pilot valve 77 also passes through the cylinder 71 and is exposed to the outside. Provided at the end of the end rod 78*b* is a reset button 78*c*. The rod 78*a* is provided with multiple piston valves 79 to 81 spaced at certain intervals. An end rod 78*d* on the other end side (the right side in the figure) of the rod 78*a* also extends from the piston valve 81, passes through the cylinder 71, and is exposed to the outside. The end of the end rod 78*d* is in contact with a latch portion 76*b* of the cam 76. In addition, the end rod 78*b* is provided with a spring 82 which applies a biasing force to the end rod 78*b* in the direction toward the cam 76.

The cylinder 71 has a port 83 on the trip piston 72 side, and the piston valve 74 forms a chamber 84. The cylinder 71 also has ports 85*a* to 85*f* on the trip pilot valve 77 side. The piston valve 79 forms a chamber 86*a*, the piston valve 79 and the piston valve 80 form a chamber 86*b*, the piston valve 80 and the piston valve 81 form a chamber 86*c*, and the piston valve 81 forms a chamber 86*d*.

On the trip piston 72 side, the control oil is supplied to and drained from the chamber 84 via the port 83. On the trip pilot valve 77 side, air is discharged or the control oil is drained from the inside of the chamber 86*a* via the port 85*a*, air is discharged or the control oil is drained from the chamber 86*a* or the chamber 86*b* via the port 85*b*, the control oil is supplied to and drained from the chamber 86*b* (supplied to and drained from the GV 93) via the port 85*c*, the control oil is supplied to the chamber 86*b* or the chamber 86*c* via the port 85*d*, the control oil is supplied to and drained from the chamber 86*c* (supplied to and drained from the TTV 91 and the ECV 92) via the port 85*e*, and air is discharged or the control oil is drained from the chamber 86*c* or the chamber 86*d* via the port 85*f*.

A pipe for supplying the control oil from the supply source of the control oil is connected to the port 85*d* and also connected to the port 83 via an orifice 94. A pipe for supplying and draining the control oil to and from the GV 93 is connected to the port 85*c*, and a pipe for supplying and draining the control oil to and from the TTV 91 and the ECV 92 is connected to the port 85*e*.

In addition, the port 83 is connected to a drain device 95. This drain device 95 includes two drainage lines having the same configuration and connected in parallel (duplex). Each drainage line includes a valve 96, a valve 97 and orifice 98 connected in parallel with the valve 96, and a solenoid valve 99 connected downstream of the valve 96, valve 97, and orifice 98.

In the conventional trip system described above, in normal operation, the solenoid valves 99 are closed, and thus, the control oil is supplied to the port 83 via the orifice 94 and also supplied to the port 85*d*, as illustrated in FIG. 6. Note that in FIG. 6, solid-line arrows indicate piping under hydraulic pressure, and broken-line arrows indicate piping without hydraulic pressure.

Thus, in normal operation, the chamber 84 is under hydraulic pressure via the orifice 94, and the hydraulic pressure of the chamber 84 opposes the biasing force of the spring 75, which prevents the trip piston 72 from moving toward the cam 76. Accordingly, the latch portion 76*b* of the cam 76 also prevents the trip pilot valve 77 from moving toward the cam 76.

In such normal operation, the control oil supplied to the port 85*d* is then supplied to the TTV 91 and the ECV 92 via the chamber 86*c* and the port 85*e*. In addition, the control oil from the GV 93 is drained via the port 85*c*, the chamber 86*b*, and the port 85*b*.

On the other hand, at the time of tripping, the solenoid valves 99 are open, and the control oil is not supplied to the port 83 (no hydraulic pressure in the chamber 84), but supplied only to the port 85*d*, as illustrated in FIG. 7. Note that also in FIG. 7, solid-line arrows indicate piping under hydraulic pressure, and broken-line arrows indicate piping without hydraulic pressure.

At the time of tripping, since the solenoid valves 99 are open, and no hydraulic pressure is applied to the chamber 84, the biasing force of the spring 75 moves the trip piston 72 toward the cam 76. Accordingly, the end of the end rod 73*d* pushes the lever portion 76*a*, turning the cam 76, and the end of the end rod 78*d* comes off the latch portion 76*b*. As a result, the biasing force of the spring 82 moves the trip pilot valve 77 toward the cam 76.

Note that in the case where the solenoid valves 99 do not open, pushing the trip button 73*c* can cause the end of the end rod 73*d* to push the lever portion 76*a* to turn the cam 76, which in turn causes the end of the end rod 78*d* to come off the latch portion 76*b*. As a result, it is possible to move the trip pilot valve 77 toward the cam 76.

At the time of tripping described above, the control oil supplied to the port 85*d* is then supplied to the GV 93 via the chamber 86*b* and the port 85*c*. The control oil from the TTV 91 and the ECV 92 is drained via the port 85*e*, the chamber 86*c*, and the port 85*f*.

The conventional trip system described above has only a single pipe line for supplying and draining the control oil to and from the TTV 91 and the ECV 92, and the single port 85*f* is used for draining the control oil. As a result, the control oil cannot be drained at a sufficient flow rate and the tripping time of the TTV 91 and the ECV 92 is long. In the conventional trip system, the emergency shut-off device 70 is disposed between the TTV 91 and the solenoid valves 99 for draining control oil.

SUMMARY

One or more embodiments of the invention provide a trip system for a steam turbine capable of providing a sufficient flow rate when the control oil is drained from the trip-and-throttle valve.

A trip system for a steam turbine according to one or more embodiments of the invention is a trip system for a steam turbine that closes a trip-and-throttle valve and a control valve of a steam turbine in an emergency, the trip system includes:

an emergency shut-off device which shuts off supply of control oil for the trip-and-throttle valve and the control valve to close the trip-and-throttle valve and the control valve; and a drain device which has a plurality of solenoid valves connected in parallel and drains the control oil by opening the solenoid valves, wherein the emergency shut-off device includes a cylinder, a piston which slides in the cylinder, a spring which applies biasing force to the piston, a plurality of piston valves provided to the piston, and a plurality of chambers formed by the piston valves, the chambers include a transfer chamber which moves the piston from a normal-operation position to an emergency position when the control oil is drained from the transfer chamber, a supply chamber which supplies the control oil to the control valve in normal operation, a control-valve drainage chamber which drains the control oil from the control valve in the emergency, and a trip-and-throttle-valve drainage chamber which drains the control oil from the trip-and-throttle valve in the emergency, and piping through which the control oil is supplied includes first piping connected to the supply chamber; and second piping passing through an orifice and connected to the drain device, the transfer chamber, the trip-and-throttle-valve drainage chamber, and the trip-and-throttle valve such that the drain device, the transfer chamber, the trip-and-throttle-valve drainage chamber, and the trip-and-throttle valve are in parallel.

One or more embodiments of the invention are directed to a trip system for a steam turbine, wherein the transfer chamber has a supply-drainage port for supplying and draining the control oil, and drains the control oil through the supply-drainage port in the emergency to allow the biasing force of the spring to move the piston from the normal-operation position to the emergency position, the supply chamber has a control-valve supply port for supplying the control oil, and communicates with a control-valve port connected to the control valve when the piston is at the normal-operation position, to supply the control oil to the control valve, the control-valve drainage chamber has a control-valve drainage port for draining the control oil, and communicates with the control-valve port when the piston is at the emergency position, to drain the control oil from the control valve, the trip-and-throttle-valve drainage chamber has a trip-and-throttle-valve port connected to the trip-and-throttle valve, and communicates with a trip-and-throttle-valve drainage port for draining the control oil when the piston is at the emergency position, to drain the control oil from the trip-and-throttle valve, the first piping is connected to the control-valve supply port, and the second piping is connected to the supply-drainage port and the trip-and-throttle-valve port as well as the drain device and the trip-and-throttle valve such that the supply-drainage port, the trip-and-throttle-valve port, the drain device, and the trip-and-throttle valve are in parallel.

One or more embodiments of the invention are directed to a trip system for a steam turbine, wherein the solenoid valves in the drain device include three solenoid valves connected in parallel, and the drain device is controlled to open two of the three solenoid valves in the emergency.

One or more embodiments of the invention are directed to a trip system for a steam turbine that comprises a hand-tripping testing apparatus including an on-off valve having one end connected to the second piping, a manual trip device having one end connected to the other end of the on-off valve and the other end being a drain side, and a pressure gauge connected between the on-off valve and the manual trip device, the hand-tripping testing apparatus being configured to drain the control oil from the second piping when the manual trip device is opened.

One or more embodiments of the invention are directed to a trip system for a steam turbine that further includes:

a stroke-testing port which communicates with the transfer chamber in the normal operation, and a stroke testing apparatus including a first two-way valve having one end connected to the supply-drainage port and the other end connected to the second piping, and a second two-way valve having one end connected to the stroke-testing port and the other end being a drain side, the stroke testing apparatus being configured to perform a stroke test of the piston by causing the first two-way valve to be closed and the second two-way valve to be opened to drain the control oil from the transfer chamber in the normal operation.

One or more embodiments of the invention are directed to a trip system for a steam turbine, wherein sliding surfaces of the piston valves have a spiral groove or a linear groove formed along an axial direction of the piston.

One or more embodiments of the present invention make it possible to provide a sufficient flow rate when draining the control oil from the trip-and-throttle valve and thus shorten the tripping time. It is also possible to improve the reliability of trip operation of the trip-and-throttle valve and the control valve. The electrical trip operation and the mechanical trip operation can be performed independently. The configuration of the emergency shut-off device is simplified, and the size is reduced compared to conventional ones, which makes it possible to improve the maintainability and the accessibility. It is also possible to check the soundness of the emergency shut-off device during operation of the steam turbine. Moreover, the arrangement conforms safety specifications.

DETAILED DESCRIPTION

Hereinafter, with reference to FIGS. 1 to 5, descriptions will be provided for embodiments of a trip system for a steam turbine according to the present invention.

EXAMPLE 1

Figure 1:
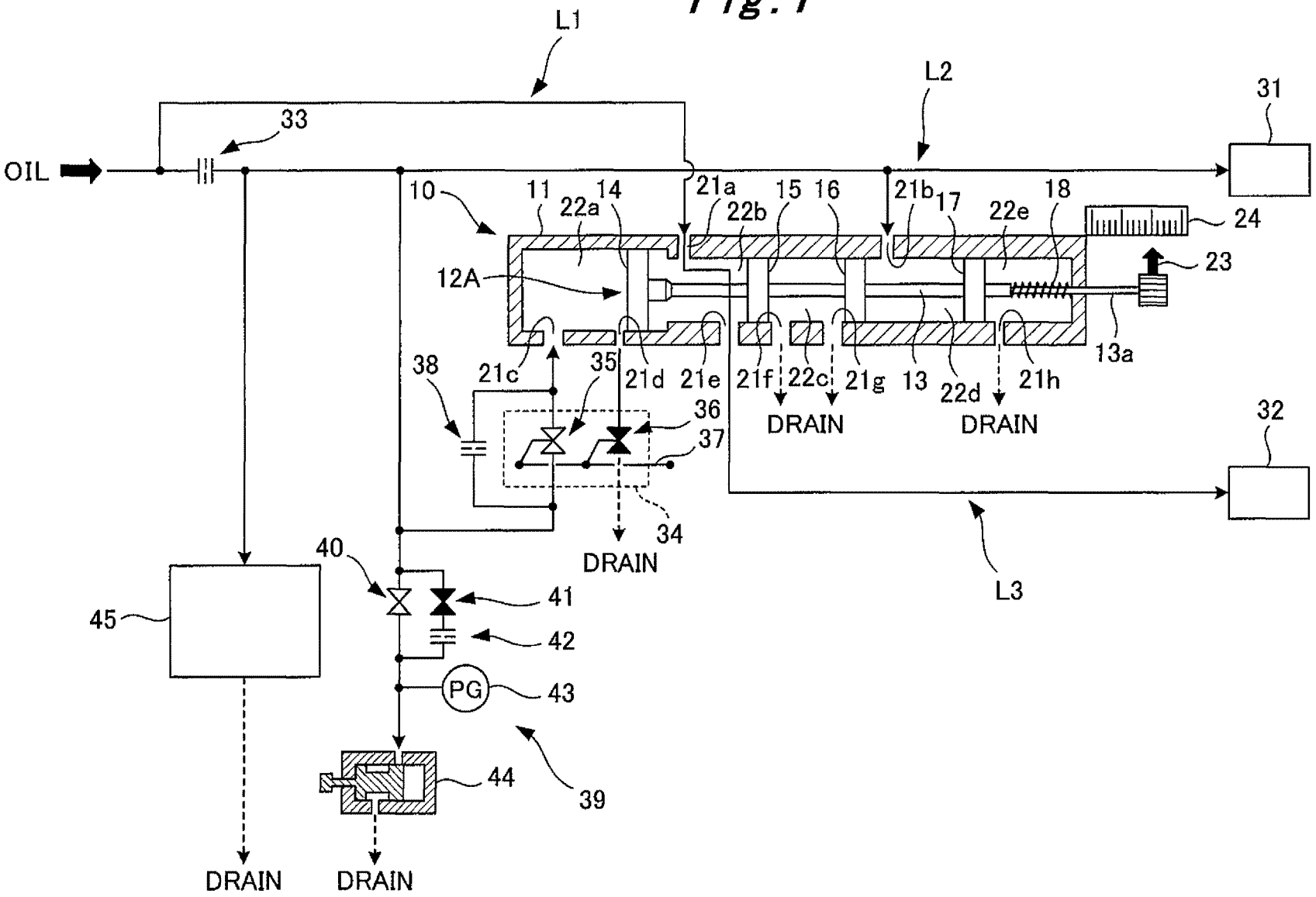
FIG. 1 is a schematic diagram illustrating an example of a trip system for a steam turbine according to one or more embodiments of the present invention, which is in a state of normal operation.
Figure 2:
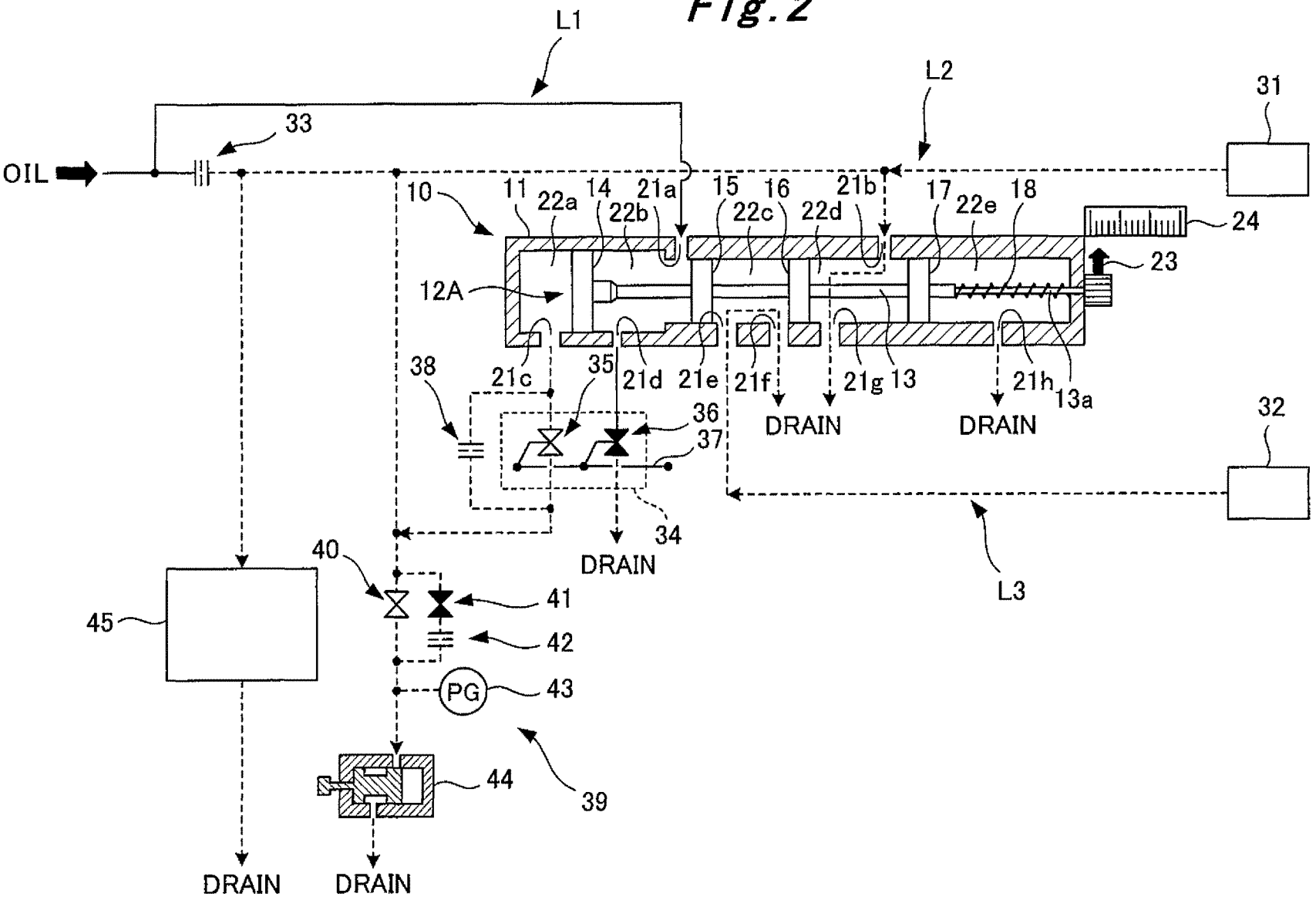
FIG. 2 is a schematic diagram illustrating the trip system for a steam turbine shown in FIG. 1 in a state at the time of tripping.

FIGS. 1 and 2 illustrate a trip system of this example. Note that FIG. 1 illustrates a state in normal operation (during operation of the steam turbine), and FIG. 1 illustrates a state at the time of tripping.

In the trip system in this example, an emergency shut-off device 10 is used to supply and drain control oil to and from a TTV 31 and an ECV 32 (a control valve) for a steam turbine (not illustrated) and shut off the supply of the control oil to close the TTV 31 and the ECV 32 in an emergency (trip operation). The control valve may be an intercept stop valve (hereinafter called an ISV) instead of the ECV 32. Incidentally, since supplying and draining control oil to and from the GV is not directly related to one or more embodiments of the present invention, the emergency shut-off device 10 shown here is of a type which does not supply and drain control oil to and from the GV.

The emergency shut-off device 10 has a single trip pilot valve 12A (piston) which slides inside a cylinder 11. In other words, unlike the conventional emergency shut-off device 70 described above, the emergency shut-off device 10 does not include two pistons (the trip piston 72 and the trip pilot valve 77). Since the conventional emergency shut-off device 70 includes two pistons, if one of the pistons adheres to the cylinder, it may lead to malfunction. However, this example includes a single piston, reducing the number of causal portions leading to malfunction. Note that as will be described later with reference to FIGS. 3 and 4, forming spiral grooves 19*a* or linear grooves 19*b* on the sliding surfaces of the piston valves 14 to 17 makes it possible to further prevent the malfunction caused by the adherence.

A rod 13 of the trip pilot valve 12A is provided with multiple piston valves 14 to 17 spaced at certain intervals in this order in the direction from one end side (the left side in the figure) toward the other end side (the right side in the figure). An end rod 13*a* at the other end side of the rod 13, extending from the piston valve 17 side, passes through the cylinder 11 and is exposed to the outside. At the end of the end rod 13*a* is provided with an indicator needle 23. With this indicator needle 23, it is possible to know the position of the trip pilot valve 12A by referring to a scale 24 provided on the cylinder 11. In addition, the end rod 13*a* is provided with a spring 18 which applies a biasing force to the end rod 13*a* in the direction toward the one end side.

The cylinder 11 has ports 21*a* to 21*h*. The piston valve 14 forms a chamber 22*a* (transfer chamber), the piston valve 14 and the piston valve 15 form a chamber 22*b* (supply chamber), the piston valve 15 and the piston valve 16 form a chamber 22*c* (control-valve drainage chamber), the piston valve 16 and the piston valve 17 form a chamber 22*d* (trip-and-throttle-valve drainage chamber), and the piston valve 17 forms a chamber 22*e*.

Here, the chamber 22*a* has the port 21*c* (supply-drainage port) for supplying and draining the control oil. In an emergency, the control oil is drained from the chamber 22*a* through the port 21*c*, causing the biasing force of the spring 18 to move the trip pilot valve 12A from a normal-operation position (see FIG. 1) to an emergency position (see FIG. 2). Note that when the trip pilot valve 12A is at the normal-operation position (see FIG. 1), the chamber 22*a* communicates with the port 21*d* (stroke-testing port).

The chamber 22*b* has the port 21*a* (control-valve supply port) for supplying the control oil. When the trip pilot valve 12A is at the normal-operation position (see FIG. 1), the chamber 22*b* communicates with the port 21*e* (control-valve port) connected to the ECV 32 to supply the control oil to the ECV 32.

The chamber 22*c* has the port 21*f* (control-valve drainage port) for draining the control oil. When the trip pilot valve 12A is at the emergency position (see FIG. 2), the chamber 22*c* communicates with the port 21*e* to drain the control oil from the ECV 32.

The chamber 22*d* has the port 21*b* (trip-and-throttle-valve port) connected to the TTV 31. When the trip pilot valve 12A is at the emergency position (see FIG. 2), the chamber 22*d* communicates with the port 21*g* (trip-and-throttle-valve drainage port) to drain the control oil from the TTV 31.

Note that the chamber 22*e* always communicates with the port 21*h* to discharge air or drain the control oil from the inside.

With the configuration above, the control oil in the chamber 22*d* communicating with the port 21*b* is always in the same state as that of the control oil in the TTV 31. Specifically, when the chamber 22*d* is under hydraulic pressure of the control oil, the TTV 31 is also under the hydraulic pressure of the control oil. Conversely, when the hydraulic pressure of the control oil is not applied to the chamber 22*d*, it is also not applied to the TTV 31.

As for piping for supplying the control oil from a control oil supply source, piping L1 (first piping) is connected to the port 21*a* of the emergency shut-off device 10. Piping L2 (second piping) connected via an orifice 33 is connected to the TTV 31 and the port 21*b* of the emergency shut-off device 10 and is also connected to a stroke testing apparatus 34, hand-tripping testing apparatus 39, and drain device 45. In other words, the TTV 31, port 21*b* of the emergency shut-off device 10, stroke testing apparatus 34, hand-tripping testing apparatus 39, and drain device 45 are connected to the piping L2 in parallel. In addition, piping L3 for supplying and draining the control oil to and from the ECV 32 is connected to the port 21*e*.

The stroke testing apparatus 34 has a two-way valve 35 (first two-way valve) having one end connected to the port 21*c* and the other end connected to the piping L2, and a two-way valve 36 (second two-way valve) having one end connected to the port 21*d* and the other end being a drainage side. Switching the open-closed states of both the two-way valves 35 and 36 can be performed at the same time with a single lever 37. For example, when the two-way valve 35 is open, the two-way valve 36 is closed. When the two-way valve 35 is closed, the two-way valve 36 is open. In addition, in parallel with the two-way valve 35 is connected an orifice 38.

In normal operation (during operation of the steam turbine), when the two-way valve 35 is closed and the two-way valve 36 is opened by operating the lever 37, part of the control oil in the chamber 22*a* is drained through the port 21*d* and the two-way valve 36. Then, the biasing force of the spring 18 moves the trip pilot valve 12A to the left in the figure, and the movement stops at a position where the piston valve 14 closes the port 21*d*. At this time, the stroke movement of the trip pilot valve 12A can be confirmed by checking the indicator needle 23 and the scale 24. In other words, it is possible to check the soundness of the emergency shut-off device 10 during operation of the steam turbine.

The hand-tripping testing apparatus 39 has an on-off valve 40 connected to the piping L2 at one end; an on-off valve 41 and an orifice 42 which are connected in parallel with the on-off valve 40; a manual trip device 44 having one end connected to the orifice 42 and the other end of the on-off valve 40, and the other end being a drainage side; and a pressure gauge 43 connected between the manual trip device 44, and the other end of the on-off valve 40 and the orifice 42. When the on-off valve 40 and the on-off valve 41 are both closed, operation of this manual trip device 44 can be tested by checking the change of the pressure gauge 43 even during operation of the steam turbine. In other words, it is possible to check the soundness of the manual trip device 44 during operation of the steam turbine.

Figure 6:
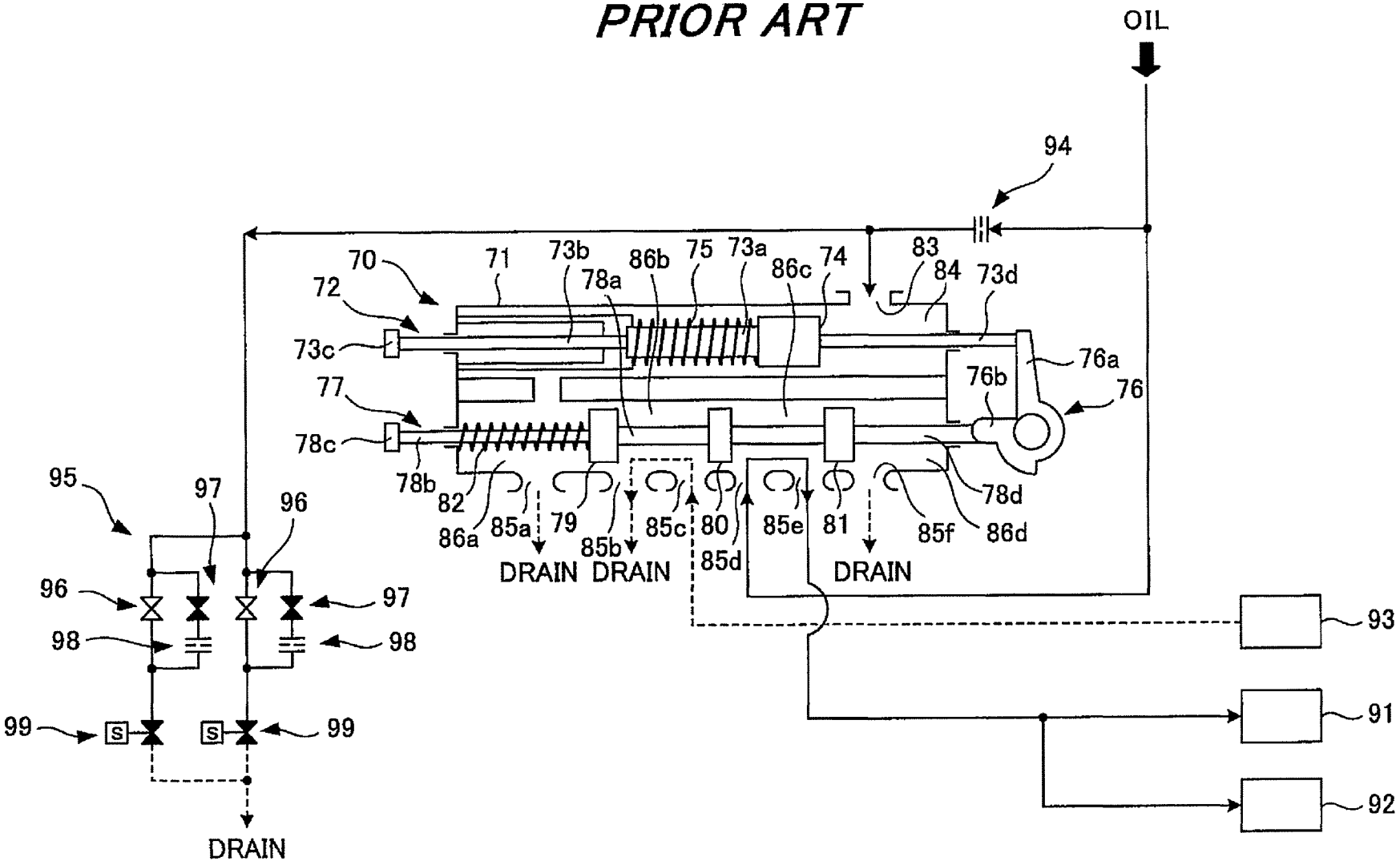
Fig. 6 PRIOR ART
FIG. 6 is a schematic diagram illustrating a conventional trip system for a steam turbine, which is in a state of normal operation.

Although the drain device 45 may have the same configuration as in the drain device 95 illustrated in FIG. 6, in this example, three oil drainage lines each having the same configuration including a solenoid valve are connected in parallel (triplex). In other words, three solenoid valves are connected in parallel. At the time of drainage (for example, in an emergency), two out of the three solenoid valves are controlled to open by electrical signals (2 out of 3 solenoid valves) and the control oil is drained from the piping L2.

In the trip system in this example described above, in normal operation, the manual trip device 44 is closed, the drain device 45 is also closed, the two-way valve 35 of the stroke testing apparatus 34 is open, and the two-way valve 35 of the stroke testing apparatus 34 is closed. Thus, as illustrated in FIG. 1, the control oil is supplied to the TTV 31, port 21*b*, and port 21*c* via the orifice 33 and is directly supplied to the port 21*a*. Note that also in FIG. 1, solid-line arrows indicate piping under hydraulic pressure, and broken-line arrows indicate piping without hydraulic pressure.

Thus, in normal operation, the chamber 22*a* is under hydraulic pressure via the orifice 33 and the two-way valve 35, so that the hydraulic pressure of the chamber 22*a* opposes the biasing force of the spring 18, and the trip pilot valve 12A is pressed in the right direction in the figure (see FIG. 1). In such normal operation, the TTV 31 is under the hydraulic pressure of the control oil, and the control oil supplied to the port 21*a* is supplied to the ECV 32 via the chamber 22*b* and the port 21*e*.

On the other hand, at the time of tripping, the drain device 45 opens, so that the control oil is not supplied to the TTV 31, port 21*b*, and port 21*c* (no hydraulic pressure is applied to the chamber 22*a*), but only supplied to the port 21*a* directly as illustrated in FIG. 2. Note that also in FIG. 2, solid-line arrows indicate piping under hydraulic pressure, and broken-line arrows indicate piping without hydraulic pressure.

At the time of tripping, the drain device 45 is open, and no hydraulic pressure is applied to the chamber 22*a*, so that the biasing force of the spring 18 moves the trip pilot valve 12A to the left in the figure (see FIG. 2). Note that in the case where drain device 45 does not open, it is possible to put the chamber 22*a* into the state without hydraulic pressure, by pressing the manual trip device 44 to drain the control oil from the chamber 22*a* via the hand-tripping testing apparatus 39.

At the time of tripping as above, the control oil in the TTV 31 is drained via the drain device 45 (or the hand-tripping testing apparatus 39), and also drained via the port 21*b*, chamber 22*d*, and port 21*g*. Meanwhile, the control oil of the ECV 32 is drained via the port 21*e*, chamber 22*c*, and port 21*f*, and thus drained through a different pipe line from the one for the TTV 31.

In this way, in the trip system of this example, the pipe lines for supplying and draining the control oil to and from the TTV 31 and the ECV 32 are independent from each other, and in addition, the TTV 31 has two pipe lines for draining the control oil. This provides a sufficient flow rate when draining the control oil from the TTV 31 and shortens the tripping time of the TTV 31 and the ECV 32. For example, it is possible to shut off steam in less than one second. In addition, in the trip system of this example, the emergency shut-off device 10 is not disposed between the TTV 31 and the solenoid valves of the drain device 45, which is desirable arrangement for safety specifications.

Figure 7:
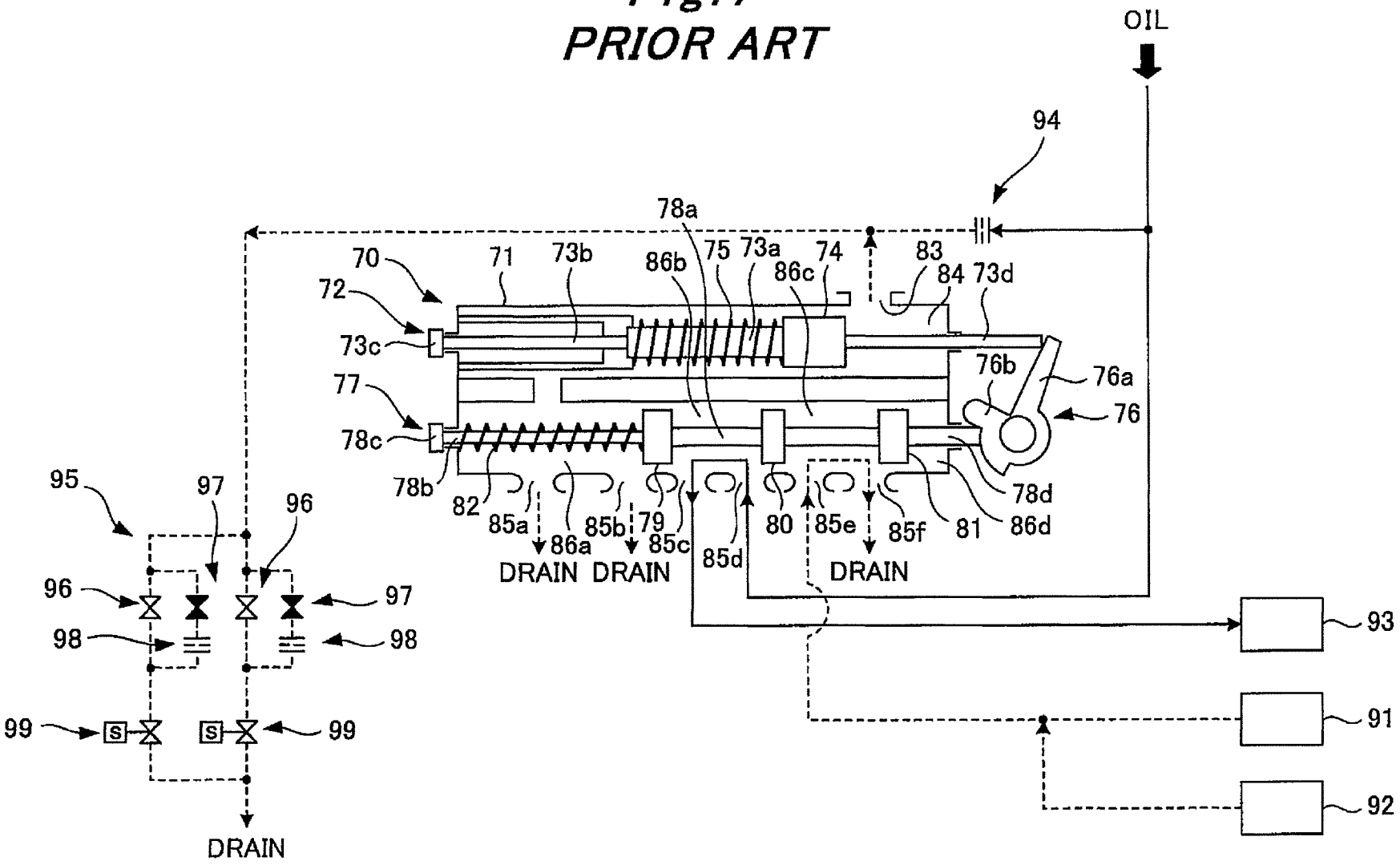
Fig. 7 PRIOR ART
FIG. 7 is a schematic diagram illustrating the trip system for a steam turbine shown in FIG. 6 in a state at the time of tripping.

Here, the following Table 1 shows the summarized comparison between the conventional trip system illustrated in FIGS. 6 and 7, and the trip system of the present example illustrated in FIGS. 1 and 2.

TABLE 1

| Trip system | Reliability (Mechanical) | Reliability (Electrical) | Reliability (Tripping) | Promptness (Tripping) |
|---|---|---|---|---|
| Conventional | Good | Good | Good | Good |
| Present Example | Excellent | Excellent | Excellent | Excellent |

| Trip system | Independence | Maintain-ability | Testing during Operation | Specification Conformity |
|---|---|---|---|---|
| Conventional | Not Meet | Difficult | Impossible | Not Meet |
| Present Example | Meet | Good | Possible | Meet |

As of the reliability (mechanical), in other words, the reliability of the emergency shut-off device, the emergency shut-off device 10 of this example uses a single piston as described above compared to two pistons used in the conventional emergency shut-off device 70, reducing the number of causal portions leading to malfunction. Thus, the reliability of the operation is improved.

As of the reliability (electrical), in other words, the reliability of the drain device in which the solenoid valves are driven by electrical signals, the trip system of this example has the configuration of 2 out of 3 solenoid valves, using the drain device 45 having the triplex oil drainage lines as described above, compared to the drain device 95 having the duplex oil drainage lines, used in the conventional trip system. Thus, the reliability of the operation is improved.

As for the reliability (tripping), in other words, the reliability of trip operation, the reliability (mechanical) and the reliability (electrical) of the trip system of this example are improved as shown in Table 1, compared to those of the conventional trip system, and thus the reliability of the trip operation for the TTV and the ECV is also improved.

As for the promptness (tripping), in other words, the promptness of the trip operation, in the trip system of this example, the pipe lines for supplying and draining the control oil to and from the TTV 31 and the ECV 32 are independent from each other, and in addition, the TTV 31 has two pipe lines for draining the control oil as described above, compared to the single pipe line for supplying and draining the control oil to and from the TTV 91 and the ECV 92 in the conventional trip system. This provides a sufficient flow rate when draining the control oil from the TTV 31 and shortens the tripping time of the TTV 31 and the ECV 32.

As for the independence, in the conventional trip system, even in the case of the drain device 95 malfunctioning, if the emergency shut-off device 70 operates normally, trip operation can be performed. On the other hand, in the case where the emergency shut-off device 70 malfunctions, even if the drain device 95 operates normally, trip operation cannot be performed, which means that the trip operation has dependence. In contrast, the trip system of this example has the hand-tripping testing apparatus 39 which is driven mechanically, in addition to the drain device 45 in which the solenoid valves are driven by electrical signals, and the hand-tripping testing apparatus 39 and the drain device 45 are connected to the piping L2 in parallel. As a result, even if one of the hand-tripping testing apparatus 39 and the drain device 45 malfunctions, if the other operates normally, trip operation can be performed. This means that the electrical trip operation and the mechanical trip operation can be performed independently.

As for the maintainability, the emergency shut-off device 10 of this example uses a single piston as described above compared to two pistons used in the conventional emergency shut-off device 70. This simplifies the configuration of the apparatus and improves the maintainability.

As for the testing during operation, the conventional trip system does not allow an operation test of the emergency shut-off device 70 during operation of the turbine. As described above, the trip system of this example has the stroke testing apparatus 34 and allows an operation test (stroke test) of the emergency shut-off device 10.

As for the specification conformity, although in the conventional trip system, the emergency shut-off device 70 is disposed between the TTV 91 and the solenoid valves 99 for draining the control oil, the emergency shut-off device 10 is not disposed between the TTV 31 and the solenoid valves of the drain device 45 in the trip system of this example as described above, which means that the arrangement conforms the safety specifications.

Note that although not shown in Table 1 above, the emergency shut-off device of this example can be downsized because the emergency shut-off device 10 of this example uses a single piston as described above compared to two pistons used in the conventional emergency shut-off device 70. As a result, the flexibility in arrangement of the emergency shut-off device 10 is improved, and this also makes it possible to improve the accessibility in normal operation and at the time of maintenance.

[Modification]

Figure 3:
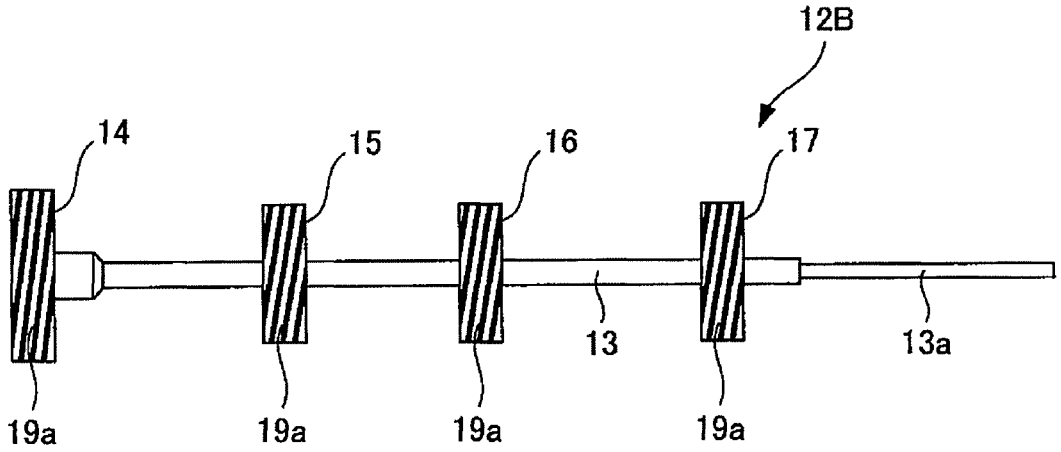
FIG. 3 is a side view illustrating an example of a trip pilot valve of the emergency shut-off device shown in FIG. 1.
Figure 4A:
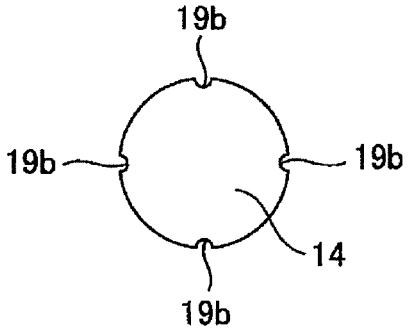
FIG. 4A is a front view diagram illustrating an example of a trip pilot valve of the emergency shut-off device shown in FIG. 1.
Figure 4B:
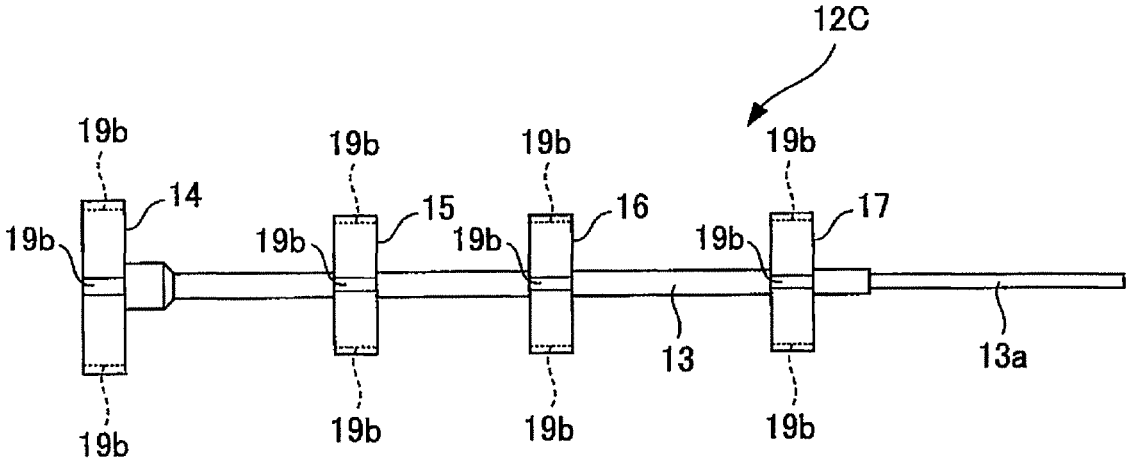
FIG. 4B is a side view diagram illustrating an example of a trip pilot valve of the emergency shut-off device shown in FIG. 1.

In the emergency shut-off device 10 described above, a trip pilot valve 12B illustrated in FIG. 3 or a trip pilot valve 12C illustrated in FIGS. 4A and 4B may be used instead of the trip pilot valve 12A.

The control oil used in the emergency shut-off device 10 may stagnate or deteriorate and cause sludge, which clogs and adhere to the sliding surfaces of the piston valves 14 to 17, causing malfunction.

To address this, the trip pilot valve 12B illustrated in FIG. 3 has spiral grooves 19*a* formed on the sliding surfaces of the piston valves 14 to 17. This spiral grooves 19*a* are used to intentionally leak a small amount of the control oil to prevent the control oil from stagnating or deteriorating, and thus preventing the occurrence of sludge. If depth R of the spiral grooves 19*a* is about 1.0 mm, the pressure loss between before and after the emergency shut-off device 10 can be suppressed to be smaller than or equal to 1%. In other words, the depth of the spiral grooves 19*a* needs to be 1.0 mm or less.

The trip pilot valve 12C illustrated in FIGS. 4A and 4B has multiple linear grooves 19*b* formed along the axial direction of the rod 13 on the sliding surface of each of the piston valves 14 to 17. Here, as an example, four linear grooves 19*b* are formed at intervals of 90° on the sliding surface of each of the piston valves 14 to 17. The trip pilot valve 12C illustrated in FIGS. 4A and 4B also provides the same effects as those of the trip pilot valve 12B illustrated in FIG. 3.

The emergency shut-off device 10 described above is used for an extraction turbine or the like with an extraction control valve (ECV). For a straight turbine without an extraction control valve (ECV), an emergency shut-off device 50 illustrated in FIG. 5 can be used.

The emergency shut-off device 50 also has a single trip pilot valve 52 (piston) which slides inside a cylinder 51. A rod 53 of the trip pilot valve 52 is provided with multiple piston valves 54 to 56 at certain intervals in this order from one end side (the left side in the figure) toward the other end side (the right side in the figure). An end rod 53*a* at the other end side of the rod 53, extending from the piston valve 56 side, passes through the cylinder 51 and is exposed to the outside. At the end of the end rod 53*a* is provided with an indicator needle 63. With this indicator needle 63, it is possible to know the position of the trip pilot valve 52 by referring to a scale 64 provided on the cylinder 51. In addition, the end rod 53*a* is provided with a spring 57 which applies a biasing force to the end rod 53*a* in the direction toward the one end side.

The cylinder 51 has ports 61*a* to 61*e*. The piston valve 54 forms a chamber 62*a*, the piston valve 54 and the piston valve 55 form a chamber 62*b*, the piston valve 55 and the piston valve 56 form a chamber 62*c*, and the piston valve 56 forms a chamber 62*d*.

Figure 5:
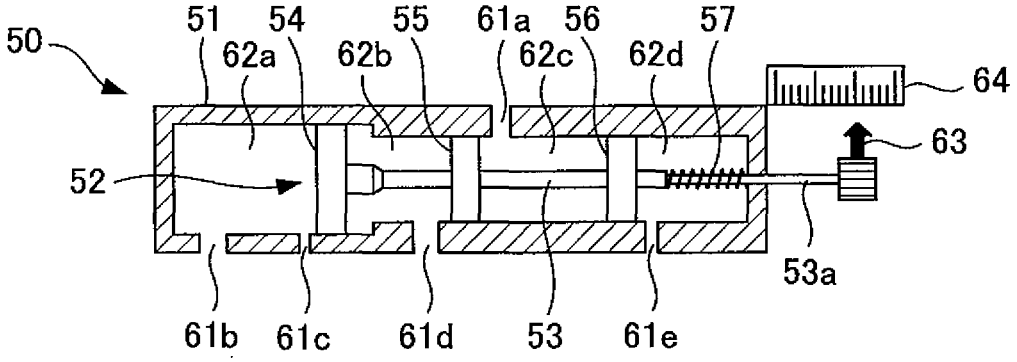
FIG. 5 is a side view illustrating an example of the emergency shut-off device shown in FIG. 1.

Here, referring to FIG. 1, the port 61*a* in FIG. 5 corresponds to the port 21*b* in FIG. 1, the port 61*b* in FIG. 5 the port 21*c* in FIG. 1, the port 61*c* in FIG. 5 the port 21*d* in FIG. 1, the port 61*d* in FIG. 5 the port 21*g* in FIG. 1, and the port 61*e* in FIG. 5 the port 21*h* in FIG. 1. In other words, the emergency shut-off device 50 illustrated in FIG. 5 does not include ports corresponding to the ports 21*a*, 21*e*, and 21*f* of the emergency shut-off device 10 illustrated in FIG. 1, which are the ports for the ECV.

Accordingly, here, the chamber 62*a* has the port 61*b* (supply-drainage port) for supplying and draining the control oil. In an emergency, the control oil is drained from the chamber 62*a* through the port 61*b*, and the biasing force of the spring 57 moves the trip pilot valve 52 from the normal-operation position to the emergency position. Note that when the trip pilot valve 52 is at the normal-operation position, the chamber 62*a* communicates with the port 61*c* (stroke-testing port).

The chamber 62*c* has the port 61*a* (trip-and-throttle-valve port) connected to the TTV. When the trip pilot valve 52 is at the emergency position, the chamber 62*c* communicates with the port 61*d* (trip-and-throttle-valve drainage port) to drain the control oil from the TTV.

Note that when the trip pilot valve 52 is at the normal-operation position, the chamber 62*b* communicates with the port 61*d*, and the chamber 62*d* always communicates with the port 61*e*, so that air is discharged or the control oil is drained from the inside through those ports.

Operation of this emergency shut-off device 50 is the same as that of the emergency shut-off device 10 illustrated in FIG. 1 except for the part related to the ECV. In addition, as described with FIGS. 3 and 4, forming the spiral grooves 19*a* or the linear grooves 19*b* on the sliding surfaces of the piston valves 54 to 56 further prevents malfunction caused by adherence.

The present invention is suitable for a steam turbine for driving a compressor or the like.

REFERENCE SIGNS LIST

10, 50 emergency shut-off device
12A, 12B, 12C, 52 trip pilot valve
14, 15, 16, 17, 54, 55, 56 piston valve
18, 57 spring
19*a* spiral groove
19*b* linear groove
31 TTV Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

The invention claimed is:

1. A trip system for a steam turbine that closes a trip-and-throttle valve and a control valve of the steam turbine in an emergency, the trip system comprising:

an emergency shut-off device that shuts off supply of control oil for the trip-and-throttle valve and the control valve to close the trip-and-throttle valve and the control valve; and a drain device that includes a plurality of solenoid valves connected in parallel and drains the control oil by opening the solenoid valves, wherein the emergency shut-off device includes:

a cylinder;

a piston that slides in the cylinder;

a spring-that applies biasing force to the piston;

a plurality of piston valves provided to the piston; and a plurality of chambers formed by the piston valves, the plurality of chambers includes:

a transfer chamber that moves, using a pressure in the transfer chamber, the piston from a normal position during normal operation to an emergency position when the control oil is drained from the transfer chamber, a supply chamber that supplies the control oil to the control valve in normal operation, a control-valve drainage chamber that drains the control oil from the control valve during the emergency, and trip-and-throttle-valve drainage chamber that drains the control oil from the trip-and-throttle valve during the emergency, and piping through which the control oil is supplied includes:

a first piping connected to the supply chamber; and a second piping that passes through an orifice and is connected to the drain device, the transfer chamber, the trip-and-throttle-valve drainage chamber, and the trip-and-throttle valve so that the drain device, the transfer chamber, the trip-and-throttle-valve drainage chamber, and the trip-and-throttle valve are in parallel.

2. The trip system for the steam turbine according to claim 1, wherein the transfer chamber includes a supply-drainage port that supplies and drains the control oil, wherein the transfer chamber drains the control oil through the supply-drainage port during the emergency to allow the biasing force of the spring to move the piston from the normal position to the emergency position, the supply chamber includes a control-valve supply port that supplies the control oil, and the supply chamber communicates with a control-valve port connected to the control valve when the piston is at the normal position, to supply the control oil to the control valve, the control-valve drainage chamber includes a control-valve drainage port that drains the control oil, and the control-valve drainage chamber communicates with the control-valve port when the piston is in the emergency position, to drain the control oil from the control valve, the trip-and-throttle-valve drainage chamber has a trip-and-throttle-valve port connected to the trip-and-throttle valve, and the trip-and-throttle-valve drainage chamber communicates with a trip-and-throttle-valve drainage port to drain the control oil when the piston is in the emergency position, to drain the control oil from the trip-and-throttle valve, the first piping is connected to the control-valve supply port, and the second piping is connected to the supply-drainage port, the trip-and-throttle-valve port, the drain device, and the trip-and-throttle valve so that the supply-drainage port, the trip-and-throttle-valve port, the drain device, and the trip-and-throttle valve are in parallel.

3. The trip system for the steam turbine according to claim 1, wherein the solenoid valves in the drain device include three solenoid valves connected in parallel, and the drain device is controlled to open two of the three solenoid valves during the emergency.

4. The trip system for the steam turbine according to claim 1, further comprising:

a hand-tripping testing apparatus including an on-off valve having a first end connected to the second piping, a manual trip device having one end connected to a second end of the on-off valve, wherein the second end is a drain side, and a pressure gauge connected between the on-off valve and the manual trip device, wherein the hand-tripping testing apparatus drains the control oil from the second piping when the manual trip device is opened.

5. The trip system for the steam turbine according to claim 1, further comprising:

a stroke-testing port that communicates with the transfer chamber in the normal operation; and a stroke testing apparatus including:

a first two-way valve having one end connected to the supply-drainage port and the other end connected to the second piping; and a second two-way valve having one end connected to the stroke-testing port and the other end being a drain side, wherein the stroke testing apparatus causes a stroke test of the piston by causing the first two-way valve to be closed and the second two-way valve to be opened to drain the control oil from the transfer chamber in the normal operation.

6. The trip system for the steam turbine according to claim 1, wherein sliding surfaces of the piston valves have a spiral groove or a linear groove formed along an axial direction of the piston.

* * * * *